US008353405B2

(12) United States Patent
Klingberg et al.

(10) Patent No.: US 8,353,405 B2
(45) Date of Patent: Jan. 15, 2013

(54) REVERSE FROTH FLOTATION OF CALCITE ORE

(75) Inventors: Anders Klingberg, Henån (SE); Elisabeth Henriksson, Kode (SE)

(73) Assignee: Akzo Nobel N.V. (NL)

( * ) Notice: Subject to any disclaimer, the term of this patent is extended or adjusted under 35 U.S.C. 154(b) by 1058 days.

(21) Appl. No.: 12/294,117

(22) PCT Filed: Apr. 18, 2007

(86) PCT No.: PCT/EP2007/053750

§ 371 (c)(1), (2), (4) Date: Sep. 23, 2008

(87) PCT Pub. No.: WO2007/122148

PCT Pub. Date: Nov. 1, 2007

(65) Prior Publication Data

US 2009/0206010 A1 Aug. 20, 2009

Related U.S. Application Data

(60) Provisional application No. 60/793,920, filed on Apr. 21, 2006.

(30) Foreign Application Priority Data

Apr. 21, 2006 (EP) ..... 06112893

(51) Int. Cl.
*B03D 1/01* (2006.01)
*B03D 1/02* (2006.01)

(52) U.S. Cl. ..... 209/166

(58) Field of Classification Search ..... 209/166
See application file for complete search history.

(56) References Cited

U.S. PATENT DOCUMENTS

| | | | | |
|---|---|---|---|---|
| 2,369,311 | A * | 2/1945 | Mead et al. | 209/166 |
| 3,990,966 | A | 11/1976 | Stanley et al. | |
| 4,293,097 | A | 10/1981 | Lewis et al. | |
| 4,892,649 | A * | 1/1990 | Mehaffey et al. | 209/166 |
| 4,995,965 | A | 2/1991 | Mehaffey et al. | |
| 5,720,873 | A | 2/1998 | Klingberg et al. | |

FOREIGN PATENT DOCUMENTS

| | | | |
|---|---|---|---|
| AT | 397 047 | B | 1/1994 |
| CA | 1 187 212 | | 5/1985 |
| DE | 196 02 856 | A1 | 7/1997 |
| EP | 0 699 106 | B1 | 1/2000 |
| EP | 1 025 908 | A1 | 8/2000 |
| FR | 2 414 067 | | 8/1979 |

OTHER PUBLICATIONS

International Search Report for International Application No. PCT/EP2007/053750, Jun. 18, 2007.

Derwent Abstract No. 88-138720/20 for Patent No. AT397047, (Jan. 1988).

Abstract No. 85-141390/24 for Patent No. CA1187212A, (May 1985).

Abstract No. 97-386492/36 for Patent No. DE19602856-A1 and for Patent No. EP1025908, (Jul. 1997).

Derwent Abstract No. 95-006437/01 for Patent No. EP0699106, (Nov. 1994).

* cited by examiner

*Primary Examiner* — Thomas M Lithgow

(74) *Attorney, Agent, or Firm* — Norris McLaughlin & Marcus, P.A.

(57) ABSTRACT

The invention relates to a reverse froth flotation process for treating a calcium carbonate ore containing silicates. The process comprises the use of two collectors selected from the group consisting of fatty tri-lower-alkyl quaternary ammonium compounds, fatty di-lower-alkyl benzyl quaternary ammonium compounds, fatty lower-alkyl di-benzyl quaternary ammonium compounds, di-fatty di-lower-alkyl quats, di-fatty lower-alkyl benzyl quats, and fatty bis-imidazoline quats. The use of a combination of different quats was found to result in a synergetic performance of the collectors.

9 Claims, No Drawings

REVERSE FROTH FLOTATION OF CALCITE ORE

This application is a 371 of PCT/EP2007/053750, filed Apr. 18, 2007, which claims priority benefit of U.S. Provisional Application No. 60/793,920, filed Apr. 21, 2006; and foreign priority benefit of European Patent Application No. 06112893.0 filed Apr. 21, 2006.

The invention relates to a method of froth floating a calcium carbonate ore containing silicates as impurities. According to the invention, froth flotation is performed using a specific combination of quaternary ammonium compounds, the silicate being concentrated in the float.

The use of quaternary ammonium compounds as collectors in reverse froth flotation processes for calcite ores has long been known. See, for instance, U.S. Pat. No. 4,995,965, where calcium carbonate and impurities, such as silicate, are separated by floating the silicate and concentrating the calcium carbonate in the remainder, in the presence of collectors such as methyl bis(2-hydroxypropyl) cocoalkyl ammonium methosulphate, dimethyl didecyl ammonium chloride, dimethyl di(2-ethylhexyl) ammonium chloride, dimethyl (2-ethyl-hexyl) cocoalkyl ammonium chloride, dicocoalkyl dimethyl ammonium chloride, and N-tallow alkyl 1,3-diamino propane diacetate. The patent specification also states that quaternary ammonium compounds as represented by Arquad® 2C (dimethyl dicocoalkyl ammonium chloride) and a combination of Duomac® T (N-tallow alkyl 1,3-diamino propane diacetate) and Ethomeen® 18/16 (long-chain alkylamine+50 EO) can be used as collectors. Also, CA 1187212 suggests amines of dimethyl di$C_{8-16}$alkyl, dimethyl $C_{10-22}$alkyl benzyl, and bis-imidazoline ($C_{12-18}$), and their salts for use as collectors. However, the combination of collectors as presently claimed is not disclosed or suggested.

U.S. Pat. No. 5,720,873 proposes to remedy the deficiencies of the process of U.S. Pat. No. 4,995,965 by using a combination of a quaternary ammonium compound and an alkoxylated amine. Similarly, AT 397047 teaches to use a combination of a quaternary ammonium compound and an ether (di)amine, which may be an alkoxylated (di)amine. While various properties were improved, the performance of such combinations is still not considered to be optimal. These references do not teach to use combinations of compounds as presently claimed.

It is noted that DE 19602856 proposes to use biodegradable esterquats as collectors in a reverse froth flotation process. However, such esterquats were found to degrade by hydrolysis and/or biologically during the flotation step, particularly in the typical process where the aqueous phase is recycled. In the calcite reverse froth flotation process, the fatty acid that results from this degradation attaches to the calcite and floats the mineral, resulting in poor yields.

Hence there is a continued need to optimize and/or find alternatives for the reverse froth flotation process of calcium carbonate ores. In this respect it is particularly important that the amount of acid-insoluble material in the product is as low as possible, the yield of product is as high as possible, and that a product of high quality (particularly brightness) is obtained. It should be realized that reducing the amount of acid-insoluble material and increasing the yield are two mutually conflicting goals. More specifically, reducing the amount of acid-insoluble material is typically achieved by floating off a large amount of material, but this reduces the yield, and vice versa.

Surprisingly, we have found that when floating calcium carbonate containing silicates as impurity, a very high yield and/or a high selectivity (low content of acid-insoluble matter) can be achieved if the reverse froth flotation process comprises the use of two or more different collectors, where at least two collectors are selected from a specific group of quaternary ammonium compounds (quats), with the proviso that these two collectors are different chemicals. Said group of quats consists of the following six subgroups; fatty tri-lower-alkyl quaternary ammonium compounds, fatty di-lower-alkyl benzyl quaternary ammonium compounds, fatty lower-alkyl di-benzyl quaternary ammonium compounds, di-fatty di-lower-alkyl quaternary ammonium compounds, di-fatty lower-alkyl benzyl quaternary ammonium compounds, and fatty bis-imidazoline quaternary ammonium compounds. It is noted that this means that at least one collector (the first collector) is selected from one of the six specified subgroups while at least one other collector (the second collector) is selected from another of these six subgroups. It is noted that for several reasons it may be less preferred to use the fatty bis-imidazoline quaternary ammonium compounds. Surprisingly, the use of a combination of two or more of such different quats results in a synergetic performance of the collectors. Further it is noted that the term lower, as in lower-alkyl, is used to denote from 1 to 7 carbon atoms, whereas a fatty group is defined to be a group having 8-36 carbon atoms.

In any embodiment according to the invention, the first collector is preferably used in a first flotation step of the process, which may comprise more than one flotation sub-step, and the second collector is used in another flotation step, which may also comprise more than one flotation sub-step. Alternatively, the two different collectors are both used at the same time in one or more of the (sub-)steps. It is even possible that all flotation sub-steps are combined in one single flotation step.

Particularly good results have been achieved when one collector is selected from the subgroups of fatty tri-lower-alkyl quats, fatty di-lower-alkyl benzyl quats, and fatty lower-alkyl di-benzyl quats, while the other collector is selected from the group consisting of di-fatty di-lower-alkyl quats, di-fatty lower-alkyl benzyl quats, and fatty bis-imidazoline quats. Hence in a specific embodiment the invention relates to reverse froth flotation processes comprising one or more flotation steps where those particular compounds are used. If there is more than one flotation step, it is preferred that the one or more fatty tri-lower-alkyl quats, fatty di-lower-alkyl benzyl quats, and fatty lower-alkyl di-benzyl quats are at least used in a certain flotation step, while the other collector is used in a later flotation step.

If collectors are used in more than one step, these steps can be performed in any order. Optionally, there is just one single step involving the use of both collectors. Processes with two or more steps involving the use of collectors are preferred.

It was observed that adding a collector, either alone or in combination, all at once (in one step) is less efficient than using the collector in various sub-steps. Hence one embodiment of the invention relates to the use of two or more collectors, with at least one of the collectors being added in two or more sub-steps. Present experimentation was limited to processes where all of one collector was used in a first step and all of the other collector was used in a subsequent step, with one or both of these steps optionally being divided into two or more sub-steps. However, the process may be optimized further, for example by first using one collector in one or more sub-steps, followed by using the other in one or more sub-steps, followed by one or more sub-steps using the first collector again, etc. Similar permutations of such potential sequences are within the scope of the present claims. The minimum amount of each collector to be used in such substeps depends on the composition being processed. The amount should be chosen such that at least frothing occurs. The maximum amount to be used in each of the steps also depends on the composition being frothed. Too high levels are uneconomical, also because they can have a negative influence on the yield of the ore.

In another embodiment of the invention, the two separate collectors are used in a specific sequence where the first collector is used in a first step and is selected from fatty tri-lower-alkyl quats, fatty di-lower-alkyl benzyl quats, and fatty lower-alkyl di-benzyl quats, and the second collector is used in a subsequent step and selected from di-fatty di-lower-alkyl quats and/or di-fatty lower-alkyl benzyl quats and/or fatty bis-imidazoline quats.

It is noted that in the present froth flotation processes the ore that is treated should be milled such that very small particles are being processed. A $d_{80}$ of less than 1 mm, preferably less than 0.3 mm is preferred, meaning that at least 80% of the particles have a size of less than 1 mm, preferably less than 0.3 mm (as determined by sieving). Older technologies using coarse particles (with a $d_{50}$ of around 2 mm in size) are not comparable because such coarse particles are not floatable, resulting in very poor yields and/or quality.

The quaternary ammonium compounds used as collectors are commercially available chemicals which may be in the pure form or in the form of a mixture of compounds. The latter typically is the case if the fatty acid fraction of the compound is based on a natural source, which typically comprises a variety of fatty acid functions, i.e. the length and saturation of the fatty group vary, as is well known in the art.

The fatty tri-lower-alkyl quats, fatty di-lower-alkyl benzyl quats, and fatty lower-alkyl di-benzyl quats can be represented by formula I,

I)

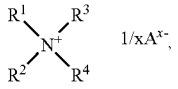

wherein $R^1$ represents a fatty group, preferably a group having 8-36 carbon atoms; optionally this hydrocarbon is unsaturated and/or substituted with one or more hydroxyl groups, preferably it is a $C_{10-22}$, most preferably a $C_{16-20}$, alkyl or alkenyl group which may be linear or branched. Said alkenyl group may have one or more unsaturated moieties. The optimum chain length is often determined by the amount of frothing observed in the process. Shorter chains tend to increase frothing (excessive frothing may lead to a reduced yield), longer chains and the use of benzyl groups may reduce frothing, but may also lead to solubility problems in the frothing process. Suitable fatty acids from which these groups can be derived include but are not limited to: lauric, myristic, palmitic, stearic, arachidic, palmitic, oleic, linoleic, linolenic, gadoleic, behenic, ricinoleic, lignoceric, and eleostearic acid. Preferably, $R^1$ is derived from natural fats and oils. Very good results were obtained using tallow-derived groups. Also hydrogenated and partially hydrogenated tallow can be used. Hydrogenation reduces frothing, but if this is desired or acceptable, then it may be preferred for ease of handling (because of its physical form).

$R^2$, $R^3$, and $R^4$ are, independently, selected from benzyl and lower-alkyl groups (including optionally lower-alkyl-substituted cycloalkyl groups) that may optionally be substituted with one or more hydroxy groups if 2 or more carbon atoms are present. Preferably, $R^2$, $R^3$, and $R^4$ are benzyl or alkyl with 1 to 5 carbon atoms, more preferably 1-3 carbon atoms, most preferably methyl, with the proviso that at most 2, preferably at most 1, of all of $R^2$, $R^3$, and $R^4$ is benzyl, A is a conventional anionic counterion, preferably selected from chloride, bromide, methosulphate, carbonate, bicarbonate, and $C_{1-3}$-alkylcarbonate, and x is the charge of the ion A.

Further collectors used in accordance with the invention are represented by:

Di-fatty di-lower-alkyl quats and/or di-fatty lower-alkyl benzyl quats, such compounds being represented by the formula

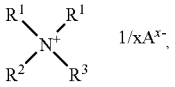

wherein A, x, $R^2$, and $R^3$ have the same meaning as given above for formula I, and each of $R^1$, independently, represents a fatty group, preferably a group having 8-36 carbon atoms; optionally this hydrocarbon is unsaturated and/or substituted with one or more hydroxyl groups, preferably it is a $C_{8-22}$, most preferably a $C_{10-18}$, alkyl or alkenyl group which may be linear or branched. Said alkenyl group may have one or more unsaturated moieties. The optimum chain length is often determined by the amount of frothing observed in the process. Shorter chains tend to increase frothing (excessive frothing may lead to a reduced yield), longer chains and the use of benzyl groups may reduce frothing, but may also lead to solubility problems in the frothing process. Suitable fatty acids from which these groups can be derived include but are not limited to: lauric, myristic, palmitic, stearic, arachidic, palmitic, oleic, linoleic, linolenic, gadoleic, behenic, ricinoleic, lignoceric, and eleostearic acid. Preferably, $R^1$ is derived from natural fats and oils. Examples of suitable di-fatty di-lower-alkyl quaternary ammonium compounds are dimethyl didecyl ammonium chloride, dimethyl dicycloalkyl ammonium chloride, dimethyl dicoco ammonium chloride, dimethyl dilauryl ammonium chloride, dimethyl distearyl ammonium chloride, dimethyl ditallow alkyl ammonium chloride, and corresponding methyl sulphate salts. Very good results were obtained using the most preferred compounds, i.e. dimethyl dicoco ammonium chloride and methyl benzyl dicoco ammonium chloride.

And fatty bis-imidazoline quats of formula II,

II)

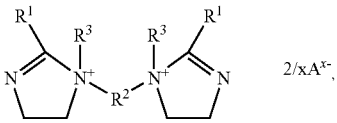

wherein each of $R^1$ and $R^3$ is, independently, selected from groups with 1-30 carbon atoms, preferably alkyl and alkaryl groups that are optionally unsaturated and/or substituted with OH groups, with the proviso that at least one of the total of $R^1$ and $R^3$ groups is a fatty group having 8-36 carbon atoms, $R^2$ is a $C_{1-10}$ hydrocarbyl group, preferably an alkylene or alkarylene group, and A and x have the meaning as given for formula I. However, for cost/efficiency reasons the use of fatty bis-imidazoline quats is less preferred.

The collectors can be applied in the process in conventional amounts. Suitably they are used in a total amount of 50-2,000 grams per metric ton (MT) of ore. As said, they can be used in one combined step or in several steps. However, it was observed that it can be beneficial to apply at least one of the collectors in several portions, where the addition of each portion can be seen as a new step in the process. Such a multi-step process was found to result in a higher efficiency of the collectors, making it possible to use less of the collector while achieving the same product yield and quality, or to use the same amount of collector and obtain an improved yield and/or quality of the product. It is noted that in each flotation step there should be an effective amount of collector. Although one cannot predict how much exactly is needed, since this depends on the type of ore, water quality, chemicals used, etc., each of the collectors according to the invention, when used in a certain step, is to be used in such a step in an amount from 5 to 2,000 grams per metric ton (MT) of ore. Preferably the lowest amount used in a step is 10 grams or more, more preferably 25 grams or more and most preferably 30 grams or more per metric ton (MT) of ore. Preferably the highest amount used in a step is 1,000 grams or less, more preferably 500 grams or less and most preferably 300 grams or less per metric ton (MT) of ore.

Using a process according to the invention, it was found that a mineral could be obtained in high yields, with low levels of acid-insolubles, and with good brightness. Further, it was observed that the use of a combination of collectors showed synergistic performance. In order to obtain a mineral with a specific brightness, the total amount of collector and co-collector to be used is less than would be expected on the basis of the effect of each of the individual collectors. Furthermore, it was observed that the amount of acid-insoluble material in the final mineral is lower than would be expected on the basis of results for the individual collectors.

In the process according to the invention, it is foreseen that further additives may be used to optimize the yield and/or quality of the reverse froth flotation process. This is particularly the case if the ore is not only contaminated with silicates but also comprises contaminants of the ore that are more hydrophobic than the ore particles. Typical additives that can be used to assist in the removal of those contaminants are substances with a water-solubility lower than the water-solubility of the collectors being used and which attach to the hydrophobic contaminants of the ore. Examples of such hydrophobic contaminants are various sulphides and graphite (coal). Examples of conventional additives that may be used to remove some of these hydrophobic contaminants include, but are not limited to, oils, including hydrocarbons, such as fuel oils, pine oil, pine tar oil, and kerosene, polar oils, cresylic acid, alcohols, such as polyglycols, e.g. polypropylene glycols with 3-7 propoxy units, 4-methyl-2-pentanol, and 2-ethyl hexanol, ethers, such as 1,1,3-triethoxy butane, esters, and certain alkoxylated amines as disclosed in, for instance, the above-mentioned U.S. Pat. No. 5,720,873. These additives can be used in the process in conventional amounts. Suitably they are used in an amount of 10-1,000 grams per metric ton (MT) of ore.

In the application of the present invention, it is possible to add, in addition to the additives mentioned above, other additives which are well-known in froth flotation. Examples of such additives are pH-adjusting agents, such as sodium carbonate and sodium hydroxide, depressants, such as starch, quebracho, tannin, dextrin and guar gum, and polyelectrolytes, such as polyphosphate and water glass, which have a dispersant effect, often combined with a depressant effect. Other conventional additives are foaming agents, such as methyl isobutyl carbinol, triethoxybutane, and polypropylene oxide and its alkyl ethers. As said, these foaming agents can also be used to remove hydrophobic contaminants from the ore, if present. If necessary, also other conventional collectors can be used in combination with the presently claimed collectors.

The invention is elucidated by the following examples.

EXPERIMENTAL

Materials Used

Arquad® 2C-75 dicoco dimethyl ammonium chloride (75% w/w) in isopropanol (15% w/w) and water (10% w/w) ex Akzo Nobel Arquad® TB tallow dimethyl benzyl ammonium chloride in isopropanol (15% w/w) and water (10% w/w) ex Akzo Nobel Lilaflot® GS 13a blend of 30-70% 2-ethylhexanol and 70-30% of hydro-carbons (Distillates (petroleum) hydrotreated light) ex Akzo Nobel, which is used to float graphite.

Procedure

The acid-insolubles content is analyzed by mixing, at room temperature in a glass beaker equipped with a magnetic stirrer bar, an amount of ore which contains a minimum of 0.02 g of acid-insolubles and 100 ml demineralized water. Then, while stirring, an aqueous 37% hydrochloric acid solution is carefully added until there is no more $CO_2$ evolution. Subsequently a watch glass is put over the glass beaker and the sample is gently boiled for 15 minutes. After cooling to room temperature the acid-insolubles content is determined gravimetrically in a conventional matter using a Versapor® 1200 membrane filter ex Pall Corp. with a diameter of 47 mm and a pore size of 1.2 μm. Before weight determination, the residue on the filter is rinsed with demineralized water and dried in an oven at 105° C. to constant weight.

The brightness of a material is determined by micronizing 75 g of material. Of the resulting powder 15 g is used to press a tablet in an Omyapress 2000 and the brightness of the tablet is measured in compliance with ISO T 452 at 457 nm, using an Elrepho® 3000 spectrophotometer ex Datacolor with a XLAV aperture plate.

Micronizing of a sample is performed by milling about 75 g of solid material with 100 ml of water in the presence of 0.4 g of Dispex A40 ex Ciba in a conventional colloid mill of 1 l size, comprising 550 ml of 1 mm zircon balls. Milling is conducted at 700 rpm for 35 minutes, or longer, until the d60 of the particles, as determined by conventional light diffraction, is below 2 μm.

Calcite ore containing about 4.5% by weight of impurities (including silicates, pyrite, and graphite) is ground in a stainless laboratory rod mill such that the $d_{50}$ is 63 μm or lower and the $d_{34}$ is 32 μm or lower. The particle size is determined using sieve sizes of 200, 125, 100, 63, 40, and 32 μm. After the milling step the amount of acid insolubles in particles smaller than 32 μm is determined to be 2.9% by weight (% w/w).

Froth flotation experiments were conducted by transferring 0.5 kg of ground ore to a 1.5-l flotation cell (type Denver Model D-12 Laboratory Flotation Machine ex Sepor Inc.). After dilution with water to a total of 1.4 l, a total of 10 ml of stock solution of the one or more collectors was added, optionally comprising further additives. After stirring the mixture for 2 minutes, the air inlet was opened and a float was withdrawn during 2 minutes. Each process step of adding stock solution, stirring the mixture, and floating was repeated as often as indicated in the tables. In the last floating step, floating was performed for 5 minutes instead of 2. Both the non-floated residue and the floated products were dried, weighed, and analyzed for acid-insoluble content. The non-floated residue was analyzed for brightness as well as for products obtained by combining froth products and non-floated material in proportions equal to the experimental outcome weight of these products, thus estimating brightness after each subsequent flotation step.

The collectors used and the results obtained appear from the following tables.

Comparative Example A

A stock solution in water containing 0.94% w/w of Arquad 2C-75 and 0.06% w/w of Lilaflot GS 13 was prepared. In Table 1 the total dosage (of Arquad 2C-75 and Lilaflot GS 13) is given together with the steps that were involved.

TABLE 1

| Step | Total dosage g/t | Acid-insolubles in non-floated solids % w/w | Calcite recovery % w/w | Brightness of non-floated solids % |
|---|---|---|---|---|
| 1 | 200 | 3.93 | 97.46 | Nm |
| 2 | 400 | 0.52 | 94.74 | Nm |
| 3 | 500 | 0.11 | 92.49 | Nm |
| 4 | 600 | 0.04 | 89.56 | 94.75 |
| 5 | 700 | 0.03 | 86.62 | 95.15 |

Nm = not measured

From the data it is observed that for 95% brightness about 660 g/t of Arquad 2C-75 is needed.

Comparative Example B

Example A was repeated, except that Arquad TB was used instead of Arquad 2C-75. The results are given in Table 2.

TABLE 2

| Step | Total dosage g/t | Acid-insolubles in non-floated solids % w/w | Calcite recovery % w/w | Brightness of non-floated solids % |
|---|---|---|---|---|
| 1 | 200 | 4.27 | 97.49 | Nm |
| 2 | 400 | 0.32 | 91.66 | Nm |
| 3 | 500 | 0.05 | 85.05 | 94.70 |
| 4 | 600 | 0.02 | 78.18 | 95.18 |

Nm = not measured

From the data it is observed that for 95% brightness about 560 g/t of Arquad TB is needed.

Example 1a

Example A was repeated, except that the stock solution contained 0.38% w/w of Arquad 2C-75, 0.56% w/w Arquad TB, and 0.06% w/w of Lilaflot GS 13. The results are given in Table 3a.

TABLE 3a

| Step | Total dosage g/t | Acid-insolubles in non-floated solids % w/w | Calcite recovery % w/w | Brightness of non-floated solids % |
|---|---|---|---|---|
| 1 | 200 | 4.36 | 98.1 | Nm |
| 2 | 400 | 0.29 | 92.1 | 94.2 |
| 3 | 500 | 0.04 | 86.58 | 95.4 |
| 4 | 600 | 0.02 | 81.37 | 95.6 |
| 5 | 700 | 0.01 | 76.7 | 95.6 |

Nm = not measured

From the data it is observed that for 95% brightness about 460 g/t of a total of Arquad 2C-75 and Arquad TB is needed.

Example 1b

Example 1b is identical to Example 1a in order to test the reproducibility of the example. The results are given in Table 3b.

TABLE 3b

| Step | Total dosage g/t | Acid-insolubles in non-floated solids % w/w | Calcite recovery % w/w | Brightness of non-floated solids % |
|---|---|---|---|---|
| 1 | 200 | 4.11 | 97.35 | Nm |
| 2 | 400 | 0.34 | 92.19 | 94.2 |
| 3 | 500 | 0.06 | 86.15 | 95.5 |
| 4 | 600 | 0.04 | 81.36 | 95.6 |
| 5 | 700 | 0.03 | 76.74 | 95.7 |

Nm = not measured

From the data it is observed that for 95% brightness about 455 g/t of a total of Arquad 2C-75 and Arquad TB is needed and that the reproducibility of the test is good.

Example 2

Example 1 was repeated, except that two stock solutions were prepared. The first stock solution contained 0.94% w/w of Arquad TB and 0.06% w/w of Lilaflot GS 13. This solution was used in step 1 and frothing in this step was performed for 5 minutes. The second stock solution contained 0.94% w/w Arquad 2C-75 and 0.06% w/w Arquad TB. This solution was used in steps 2-4. The results are given in Table 4.

TABLE 4

| Step | Total dosage g/t | Acid-insolubles in non-floated solids % w/w | Calcite recovery % w/w | Brightness of non-floated solids % |
|---|---|---|---|---|
| 1 | 220 | 3.65 | 95.73 | Nm |
| 2 | 320 | 0.95 | 92.39 | 87.22 |
| 3 | 420 | 0.10 | 90.05 | 93.99 |
| 4 | 520 | 0.04 | 88.02 | 94.90 |

Nm = not measured

From the data it is observed that for 95% brightness about 540 g/t of Arquad 2C-75 and Arquad TB is needed.

Example 3

Example 2 was repeated using the same stock solutions. The first stock solution was used in steps 1 and 2, the second stock solution in steps 3-5. The results are given in Table 5.

TABLE 5

| Step | Total dosage g/t | Acid-insolubles in non-floated solids % w/w | Calcite recovery % w/w | Brightness of non-floated solids % |
|---|---|---|---|---|
| 1 | 200 | 3.99 | 97.4 | Nm |
| 2 | 330 | 0.69 | 92.4 | 92.6 |
| 3 | 430 | 0.09 | 88.2 | 94.9 |
| 4 | 530 | 0.04 | 85.7 | 95.2 |
| 5 | 630 | 0.03 | 83.8 | 95.3 |

Nm = not measured

From the data it is observed that for 95% brightness about 440 g/t of Arquad 2C-75 and Arquad TB is needed.

Example 4

Example 2 was repeated, except that 11 ml of the first stock solution was added in step 1 and 16.5 ml of the second stock solution was added in step 2. The results are given in Table 6.

TABLE 6

| Step | Total dosage g/t | Acid-insolubles in non-floated solids % w/w | Calcite recovery % w/w | Brightness of non-floated solids % |
|---|---|---|---|---|
| 1 | 220 | 3.61 | 95.83 | Nm |
| 2 | 550 | 0.05 | 83.38 | 95.07 |

Nm = not measured

From the data it is observed that for 95% brightness about 550 g/t of Arquad 2C-75 and Arquad TB is needed.

The results are summarized in Table 7. Here the total level of the collectors needed to give 95% brightness is presented, together with the calcite recovery (yield) and the amount of acid-insolubles at this dosage level.

TABLE 7

| Example | Total dosage g/t | Percentage of Arquad TB in collector | Acid-insolubles in non-floated solids % w/w | Yield % |
|---|---|---|---|---|
| A | 660 | 0 | 0.04 | 87.8 |
| B | 560 | 100 | 0.03 | 80.9 |
| 1a + b | 458 | 60 | 0.06 | 88.8 |
| 2 | 540 | 40 | 0.04 | 87.8 |
| 3 | 440 | 75 | 0.08 | 88.0 |
| 4 | 550 | 60 | 0.05 | 83.5 |

It is clearly shown that the combination of the two collectors results in a synergetic removal of contaminants from the ore, while the level of insolubles in the non-floated solids is kept at a comparable level.

The invention claimed is:

1. Reverse froth flotation process for treating a calcium carbonate ore containing silicates, said process comprising one or more flotation steps, wherein in said process at least two collectors are employed, and wherein one of said collectors is selected from the group consisting of the subgroup: fatty di-lower-alkyl benzyl quaternary ammonium compounds; and one of said collectors is selected from the group consisting of the subgroup: di-fatty di-lower-alkyl quaternary ammonium compounds.

2. The process of claim 1 comprising at least two steps wherein one or more collectors from a first subgroup are used in the first step and one or more other collectors of another subgroup are used in the second step, and wherein each step may consist of two or more substeps.

3. The process of claim 1 wherein the fatty di-lower-alkyl benzyl quaternary ammonium compounds are of the formula

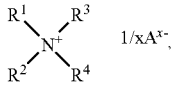

$1/xA^{x-}$, wherein $R^1$ represents a fatty group, optionally unsaturated and/or substituted with one or more hydroxyl groups which may be linear or branched, $R^2$ is benzyl, and $R^3$ and $R^4$ are each, independently, selected from lower-alkyl groups that may optionally be substituted with one or more hydroxy groups if 2 or more carbon atoms are present, A is a conventional anionic counterion, and x is the charge of the counterion.

4. The process of claim 1 wherein said di-fatty di-lower-alkyl quaternary ammonium compounds are represented by the formula

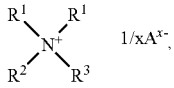

$1/xA^{x-}$, wherein each of $R^1$, independently, represents a fatty group, optionally unsaturated and/or substituted with one or more hydroxyl groups, and $R^2$ and $R^3$ are each, independently, selected from lower-alkyl groups that may optionally be substituted with one or more hydroxy groups if 2 or more carbon atoms are present, A is a conventional anionic counterion, and x is the charge of the counterion.

5. The process of claim 1 comprising a first and second flotation step, wherein in said first flotation step the collector is selected from fatty di-lower-alkyl benzyl quaternary ammonium compounds, and the collector in said second step is selected from the group consisting of di-fatty di-lower-alkyl quaternary ammonium compounds.

6. The process of claim 1 wherein a total amount of 50-2,000 grams of collector is used per metric ton (MT) of ore.

7. The process of claim 1 which further comprises addition of an additive to assist in the removal from the ore of contaminants that are more hydrophobic than calcium carbonate, wherein said additive has a water solubility lower than the water solubility of the collectors employed.

8. The process of claim 7 wherein 10-2,000 grams of the additive are used per metric ton of ore.

9. The process of claim 1 wherein the ore treated has a particle size distribution such that $d_{80}$ is less than 0.3 mm.

* * * * *